US007201236B1

(12) United States Patent
Nickel et al.

(10) Patent No.: US 7,201,236 B1
(45) **Date of Patent: *Apr. 10, 2007**

(54) APPARATUS AND METHOD FOR TRACKING MULTIPLE SIGNAL EMITTING OBJECTS

(75) Inventors: Frank S. Nickel, Perry, OK (US); Jian Jin, Pella, IA (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/339,039

(22) Filed: Jan. 25, 2006

Related U.S. Application Data

(63) Continuation of application No. 10/918,331, filed on Aug. 13, 2004, now Pat. No. 7,013,990, which is a continuation of application No. 10/318,288, filed on Dec. 11, 2002, now Pat. No. 6,776,246.

(51) Int. Cl.
*E21B 47/02* (2006.01)

(52) U.S. Cl. ..... 175/45; 175/40; 175/61; 324/326

(58) Field of Classification Search ..... 175/40, 175/45, 61
See application file for complete search history.

(56) References Cited

U.S. PATENT DOCUMENTS 4,542,344 A 9/1985 Darilek et al.
4,622,644 A 11/1986 Hansen
4,881,083 A 11/1989 Chau et al.
5,093,622 A 3/1992 Balkman
5,230,387 A 7/1993 Waters et al.
5,361,029 A 11/1994 Rider et al.
5,430,379 A 7/1995 Parkinson et al.
5,558,091 A 9/1996 Acker et al.
5,633,589 A 5/1997 Mercer
5,720,354 A 2/1998 Stump et al.
5,725,059 A 3/1998 Kuckes et al.
5,729,129 A 3/1998 Acker
5,757,190 A 5/1998 Mercer
5,904,210 A 5/1999 Stump et al.
5,914,602 A 6/1999 Mercer
5,920,194 A 7/1999 Lewis et al.
5,923,170 A 7/1999 Kuckes
5,990,682 A 11/1999 Mercer
5,990,683 A 11/1999 Mercer (Continued)

OTHER PUBLICATIONS

"The S6 Locating System" SeekTech™ sales brochure, San Diego, California.

*Primary Examiner*—Frank Tsay
(74) *Attorney, Agent, or Firm*—Tomlinson & O'Connell, PC

(57) ABSTRACT

A portable area monitoring system for use with a horizontal directional drilling machine and adapted to produce a composite of the positions of a beacon and a fixed object. In a preferred embodiment the sensor assembly is supported by a hand-held frame and adapted to detect signals emanating from each of a beacon and a fixed object. The sensor assembly transmits the detected signals to a processor which simultaneously processes the signals to produce a composite of relative positions of the beacon and the fixed object to the frame. The composite of the relative positions of the beacon and the fixed object to the frame is communicated to the operator using a portable display.

41 Claims, 9 Drawing Sheets

U.S. PATENT DOCUMENTS

| | | | |
|---|---|---|---|
| 6,008,651 | A | 12/1999 | Mercer |
| 6,035,951 | A | 3/2000 | Mercer et al. |
| 6,047,783 | A | 4/2000 | Mercer et al. |
| 6,057,687 | A | 5/2000 | Mercer |
| 6,073,043 | A | 6/2000 | Schneider |
| 6,079,506 | A | 6/2000 | Mercer |
| 6,095,260 | A | 8/2000 | Mercer et al. |
| 6,119,376 | A | 9/2000 | Stump |
| 6,250,402 | B1 | 6/2001 | Brune et al. |
| 6,308,787 | B1 | 10/2001 | Alft |
| 6,408,952 | B1 | 6/2002 | Brand et al. |
| 6,496,008 | B1 | 12/2002 | Brune et al. |
| 6,586,937 | B2 | 7/2003 | Goodman |
| 6,653,837 | B2 | 11/2003 | Brune et al. |
| 6,737,867 | B2 | 5/2004 | Brune et al. |
| 7,009,399 | B2 | 3/2006 | Olsson et al. |
| 2004/0070535 | A1 | 4/2004 | Olsson et al. |
| 2005/0156600 | A1 | 7/2005 | Olsson et al. |

APPARATUS AND METHOD FOR TRACKING MULTIPLE SIGNAL EMITTING OBJECTS

CROSS REFERENCE TO RELATED APPLICATION

This application is a continuation of U.S. application Ser. No. 10/918,331 filed Aug. 13, 2004, now U.S. Pat. No. 7,013,990 which is a continuation of U.S. application Ser. No. 10/318,288 filed on Dec. 11, 2002, now U.S. Pat. No. 6,776,246.

FIELD OF THE INVENTION

The present invention relates generally to the field of locating underground objects, and in particular to simultaneously tracking a beacon and locating buried objects within the field of operation of a horizontal drilling machine.

SUMMARY OF THE INVENTION

The present invention is directed to a portable area monitoring system for monitoring the position of a plurality of signal emitting objects within an operating area. The monitoring system comprises a sensor assembly and a processor. The sensor assembly is adapted to detect a plurality of signals emanating from the plurality of signal emitting objects and to transmit the plurality of detected signals. The processor is adapted to receive the plurality of detected signals, to process the plurality of detected signals, and to produce a composite of the relative positions of the monitoring system and the plurality of signal emitting objects within the operating area.

The invention further includes a horizontal directional drilling system. The horizontal directional drilling system comprises a horizontal directional drilling machine, a drill string connectable to the horizontal directional drilling machine, a beacon supported on the drill string, and a portable area monitoring system. The portable area monitoring system is adapted to monitor the position of the beacon and a fixed object. The positions of the beacon and the fixed object are monitored within an operating area in which the horizontal directional drilling machine operates. The monitoring system comprises a frame, a sensor assembly, and a processor. The sensor assembly is supported by the frame and adapted to detect signals emanating from the fixed object, to detect signals emanating from the beacon, and to transmit the detected signals. The processor is adapted to receive the detected signals, to process the signals, and to produce a composite of the relative positions of the frame, the beacon, and the fixed object within the operating area.

Still further, the present invention includes system for determining the position of each of a plurality of signal emitting objects disposed within an operating area. The system comprises a sensor assembly, a processor, and a communications link. The sensor assembly is adapted to detect a plurality of signals emanating from the plurality of signal emitting objects and to transmit the plurality of detected signals. The processor is adapted to receive the detected signals, to process the plurality of detected signals, and to produce a composite of the relative positions of the sensor assembly and the plurality of signal emitting objects within the operating area. The communications link is adapted to transmit information indicative of the positions of each of the signal emitting objects.

Finally, the present invention includes a method for monitoring the position of a plurality of signal emitting objects disposed within an area of operation. The method uses a portable area monitoring system and comprises sensing a plurality of signals emitted from the plurality of signal emitting objects, and processing the plurality of signals to generate a composite of the relative positions of the monitoring system and each of the plurality of signal emitting objects within the operating area.

BRIEF DESCRIPTION OF THE DRAWINGS

FIG. 1 illustrates the use of a portable area monitoring system to monitor the position of a beacon and a fixed object within the area of operation of a horizontal directional drilling machine.

In FIG. 2, the fixed object is a utility line having a signal generator operatively connected thereto.

FIG. 3 illustrates a sensor assembly having two antenna assemblies supported by a hand-held frame.

FIG. 9 is a plan view of the sensor assembly showing the geometry and antennas used to calculate the azimuth angle of the fixed object.

DETAILED DESCRIPTION OF THE PREFERRED EMBODIMENTS

Figure 1:
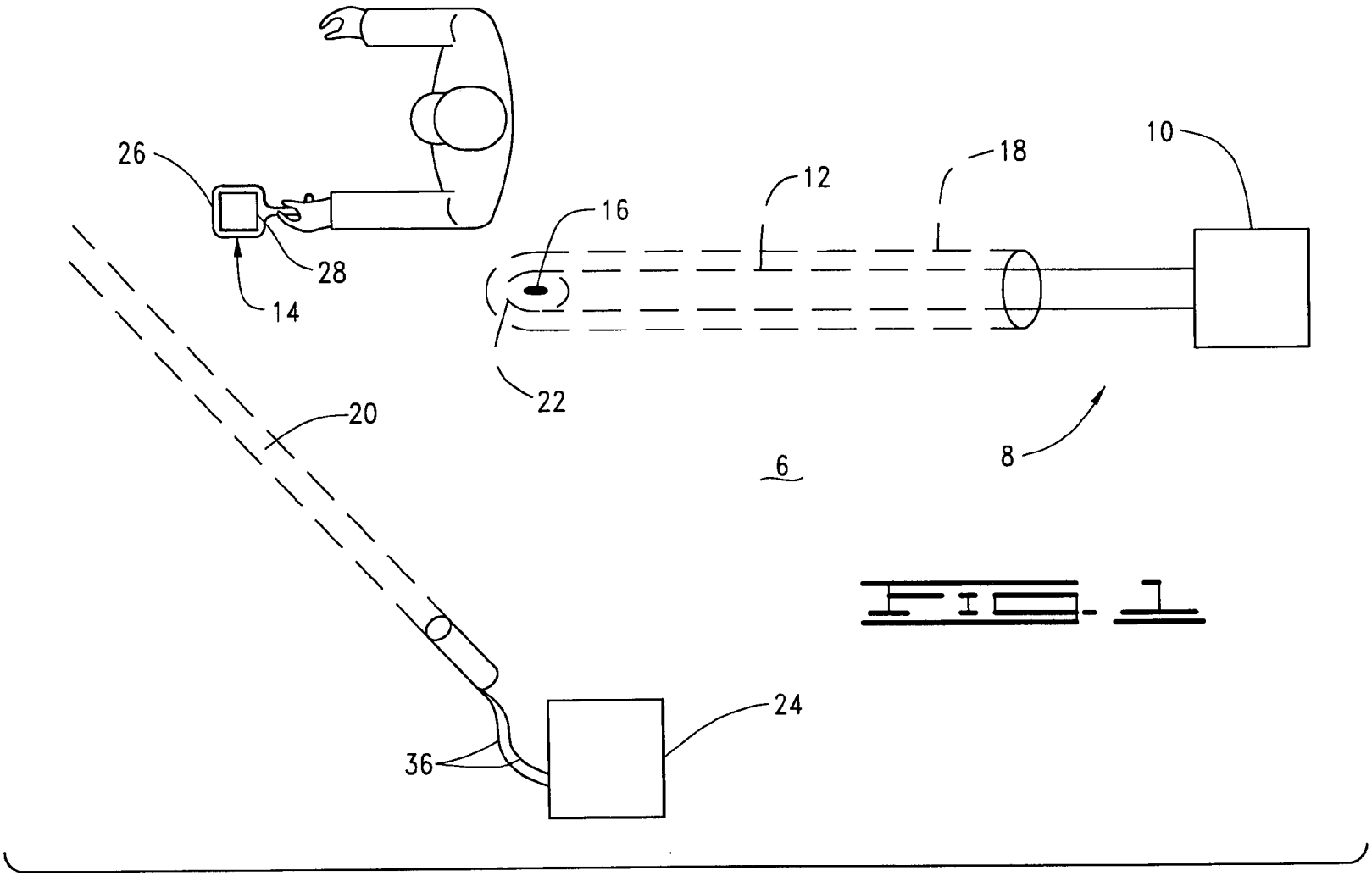
FIG. 1 is an over-head diagrammatic representation of an area in which a boring operation is being conducted using a horizontal directional drilling system.

Turning now to the drawings in general and FIG. 1 in particular, there is shown therein the operating area 6 of a horizontal directional drilling system 8. The horizontal directional drilling system 8 uses a horizontal directional drilling machine 10, a drill string 12, a portable area monitoring system 14, and a beacon 16 to make generally horizontal boreholes 18 for the installation of underground utilities. Horizontal directional drilling has proved advantageous because a utility can be installed without disturbing surface structures such as roadways or buildings. However, problems and losses may be associated with accidental strikes of underground objects 20, such as telecommunications lines, cable television service, electrical service, water lines, sewers and other utility connections. Thus, a need has developed for systems adapted to track the position of a subsurface boring tool 22, or other trenchless device, relative to the fixed object 20 to prevent accidentally striking the fixed object.

The present invention utilizes a portable area monitoring system 14 having the ability to monitor the position and orientation of the beacon 16 supported by the boring tool 22 and the fixed object 20 within the operating area 6 of the horizontal directional drilling machine 10. A signal generator 24 is connected to the fixed object 20 to impress a signal, having a known frequency, onto the fixed object. For purposes of illustration, the fixed object 20 of FIG. 1 is a linear utility line. However, it will be appreciated that the fixed object may be any object that emits a signal capable of detection by the portable area monitoring system 14. The portable area monitoring system 14 detects signals emanating from the beacon 16 and the fixed object 20 and produces a composite indicative of the relative positions of the portable area monitoring system, the beacon, and the fixed object within the operating area. The portable area monitoring system 14 may then communicate the relative positions of the beacon 16 and the fixed object 20 either visually or by audio signals. In the present embodiment, the portable area monitoring system 14 comprises a frame 26 which may be outfitted with a display 28. The display 28 communicates the composite of the relative positions of the frame 26, the beacon 16, and the fixed object 20 within the operating area 6.

Figure 2:
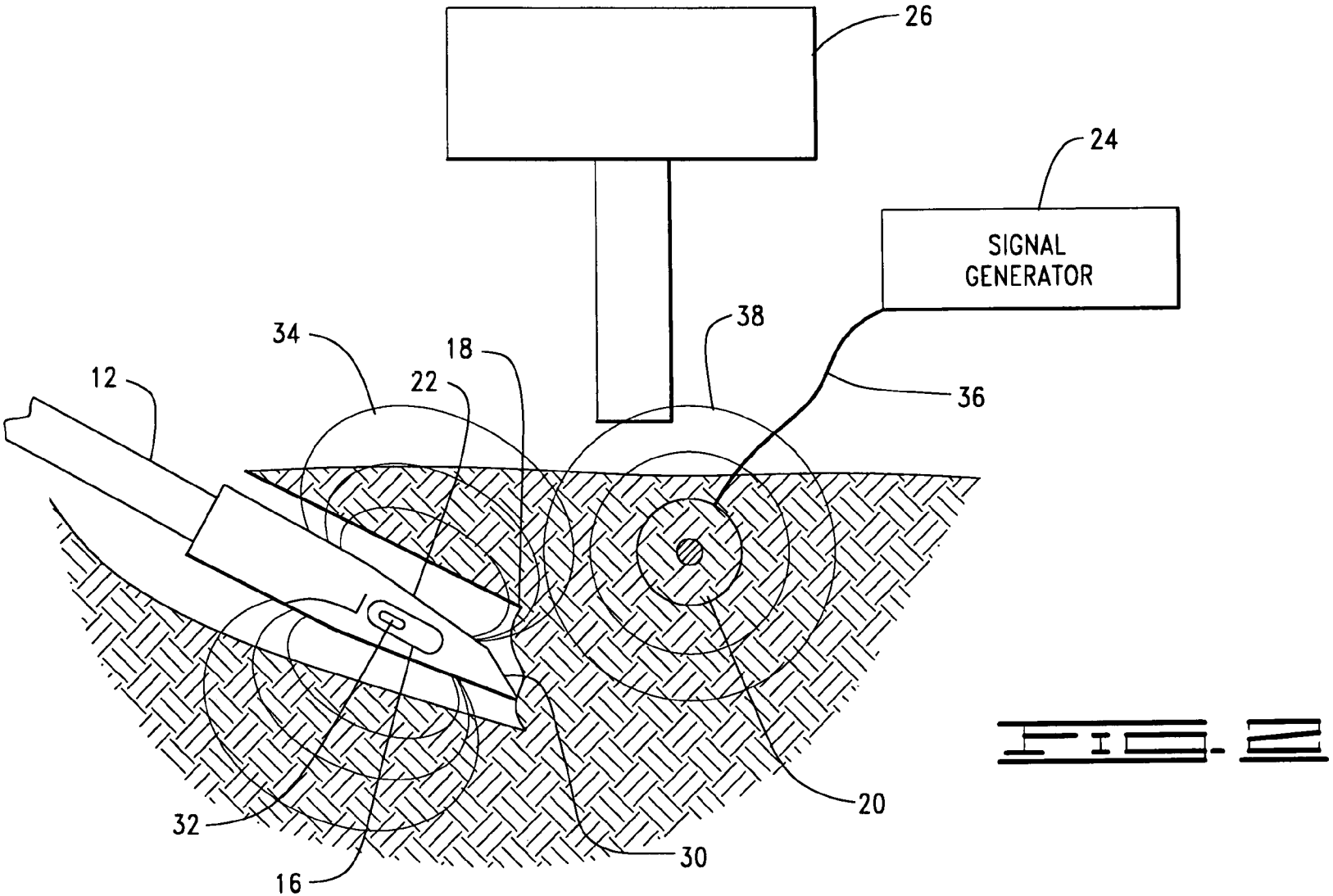
FIG. 2 is a diagrammatic view of a signal generating beacon supported within a boring tool, a portable area monitoring system, and a fixed object disposed within the ground.

Turning now to FIG. 2, there is shown therein the relationship between the boring tool 22, the fixed object 20 and the frame 26 of the portable area monitoring system 14. The boring tool 22 is shown connected to the drill string 12 and disposed within the borehole 18. The boring tool 22 is adapted to support the beacon 16 in a position proximate a drill bit 30. The beacon 16 may have a transmitter 32 capable of emitting magnetic field signals, at a frequency in the range of 8–40 kHz, comprising a vector field having a plurality of vector field components. The vector field components emanating from the beacon 16 may comprise a magnetic field 34. The magnetic field 34 emitted from the beacon 16 may comprise a dipole magnetic field. The use of a magnetic field to locate an underground boring tool, as discussed herein, is disclosed in more detail in U.S. Pat. No. 5,174,033 issued to Rider, the contents of which are incorporated herein by reference.

Continuing with FIG. 2, the fixed object 20 is shown in cross section and connected to signal generator 24 via an electrical lead 36. The signal generator 24 impresses a signal, such as an alternating current (AC) signal on the object 20. The impressed signal causes a magnetic field 38 to emanate from the fixed object 20 at a frequency different from that transmitted by the beacon 16. In addition, the signal generator 24 may sequentially impress a single signal on multiple utility lines or use coding techniques, such as using multiple operating frequencies, to impress simultaneous signals on multiple lines. The signal generator 24 typically may impress signals that are from less than 1 kilo-hertz (kHz) to 300 kHz with nominal outputs at approximately 1 kHz, 8 kHz, 29 kHz, 33 kHz, 34 kHz, 80 kHz, and 300 kHz. However, it will be appreciated that lower and higher frequencies may be used.

The portable area monitoring system 14 determines the magnetic fields that are produced by the signal currents impressed on the object 20 and emanating from the beacon 16. As explained more fully below, the system 14 uses a sensor assembly to detect and measure the vector field components emanating from the fixed object 20 and from the beacon 16. Then, a composite of the relative positions of the frame 26, the beacon 16 and the fixed object 20, including the distance from the frame to each of the beacon and the object, can be determined.

Figure 3:
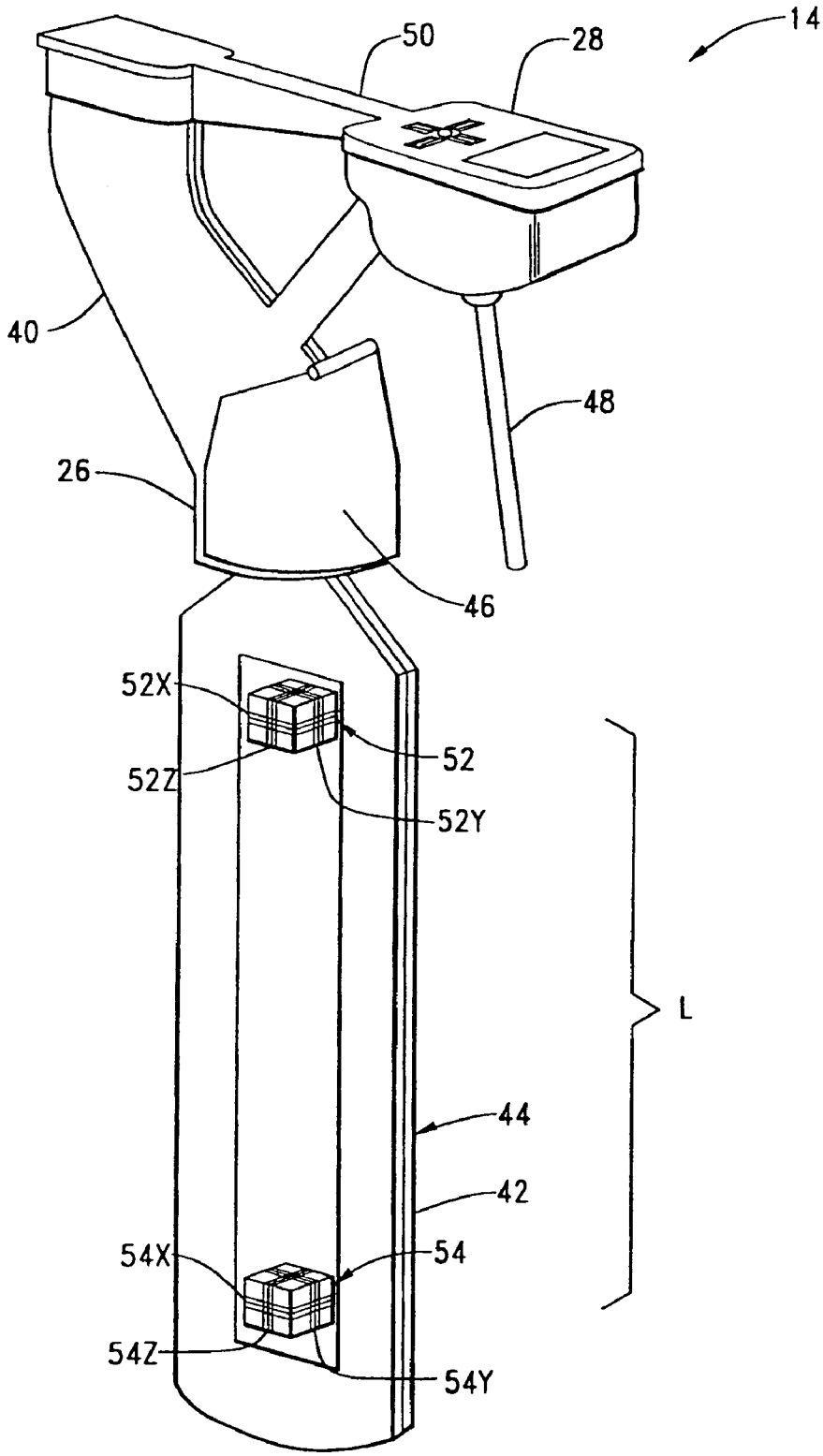
FIG. 3 is a perspective, partially cut-away view of a portable area monitoring system constructed in accordance with the present invention.

Turning now to FIG. 3, the portability of the portable area monitoring system 14 becomes evident. In FIG. 3 there is shown the frame 26 comprising a handheld unit having an upper portion 40 and a lower portion 42. A sensor assembly 44 adapted to detect the magnetic field components emanating from the beacon 16 and the fixed object 20 is disposed within the lower portion 42.

The upper portion 40 includes a battery compartment 46, the display 28, a data link antenna 48, and a handle 50 for carrying the frame 26. The battery compartment 46 is used to secure a power supply within the frame 26 during operation of the portable area monitoring system 14. The data link antenna 48 may comprise one component of a circuit and system to transmit information to a receiving device using a fixed frequency, a variable frequency, or some other wireless method. The information may be transmitted to a receiver located at the horizontal directional drilling machine 10 to assist the operator in steering the boring tool 22.

Figure 7:
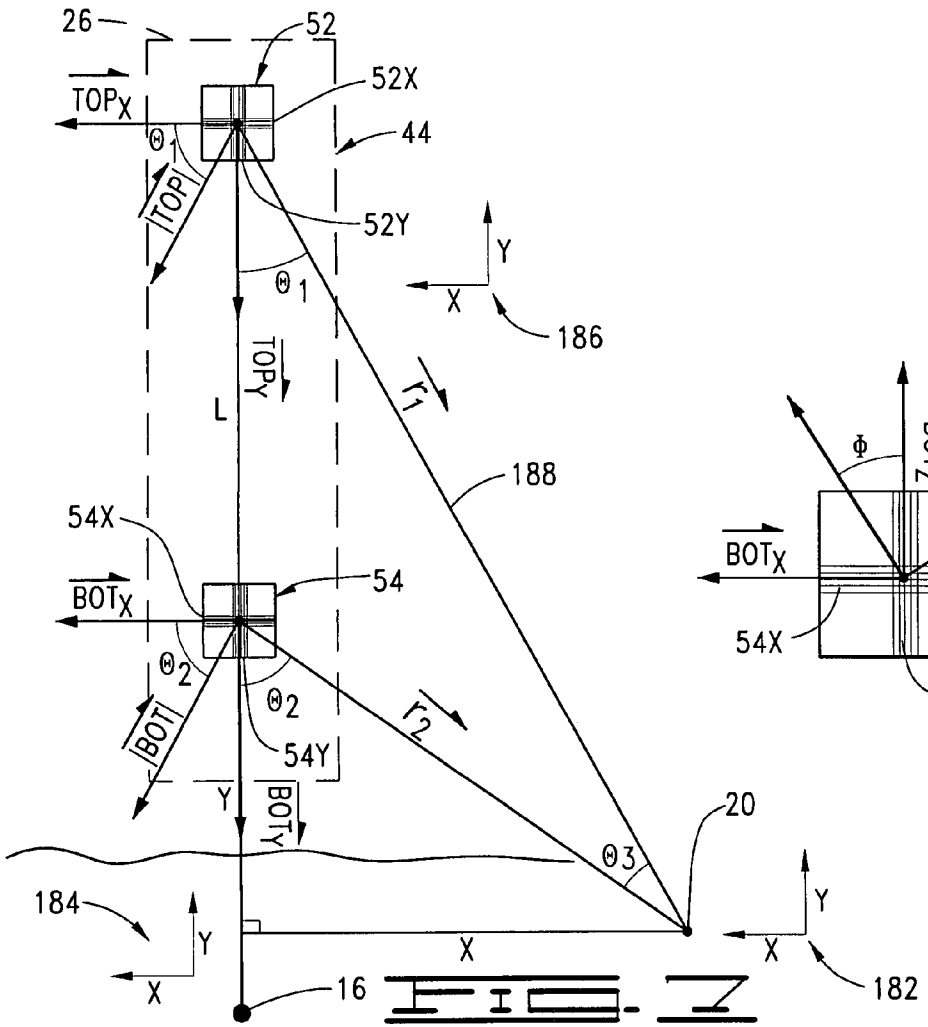
FIG. 7 is a diagram of the sensor assembly showing the geometry and antennas used to calculate the relative positions of the frame, the beacon, and the fixed object within the operating area.

The sensor assembly 44 is adapted to detect the signals emanating from both the fixed object 20 and the beacon 16 and to transmit the detected signals to a processor. The sensor assembly 44 may comprise a plurality of magnetic field sensors adapted to detect a plurality of the magnetic field components emanating from both the beacon 16 and the fixed object 20. The magnetic field sensors preferably form two antenna arrays 52 and 54 separated a known distance L. For purposes of illustration, antenna arrays 52 and 54 are shown in a top and bottom arrangement. The significance of this arrangement will become apparent during the discussion of FIGS. 7 and 8.

Antenna arrays 52 and 54 comprise three coils 52*x*, 52*y*, 52*z*, and 54*x*, 54*y*, and 54*z*, respectively, oriented such that each coil of each array is mutually orthogonal to the other two. Arranging the coils in this manner allows the sensor assembly 44 to measure the magnetic field components emanating from the beacon 16 and the fixed object 20 in three planes.

With reference to FIGS. 2 and 3, the way in which the portable area monitoring system is used to track the beacon 16 is shown. Conventionally, the transmitter 32 is arranged within the beacon 16 so that the longitudinal axis of the transmitter is coaxial with the longitudinal axis of the beacon. The coils 52*z* and 54*z* will produce a maximal response when the coils 52*z* and 54*z* are positioned directly over the beacon 16. Thus, the sensor assembly 44 is moved in front of and behind the approximate location of the beacon 16 until a peak response is indicated on the display 28. Then, the sensor assembly 44 is moved to the left and right of the estimated position of the beacon 16 to confirm the point on the ground corresponding to the underground location of the beacon. After positioning the frame 26, the sensor assembly 44 may be used to determine the depth of the beacon 16 whether over the beacon or not. It will be appreciated, however, that location and depth may be determined without positioning the monitoring system 14 directly above the beacon. The system 14 may be positioned anywhere within operating area 6 and moved when the signal from beacon 16 substantially weakens.

Figure 4:
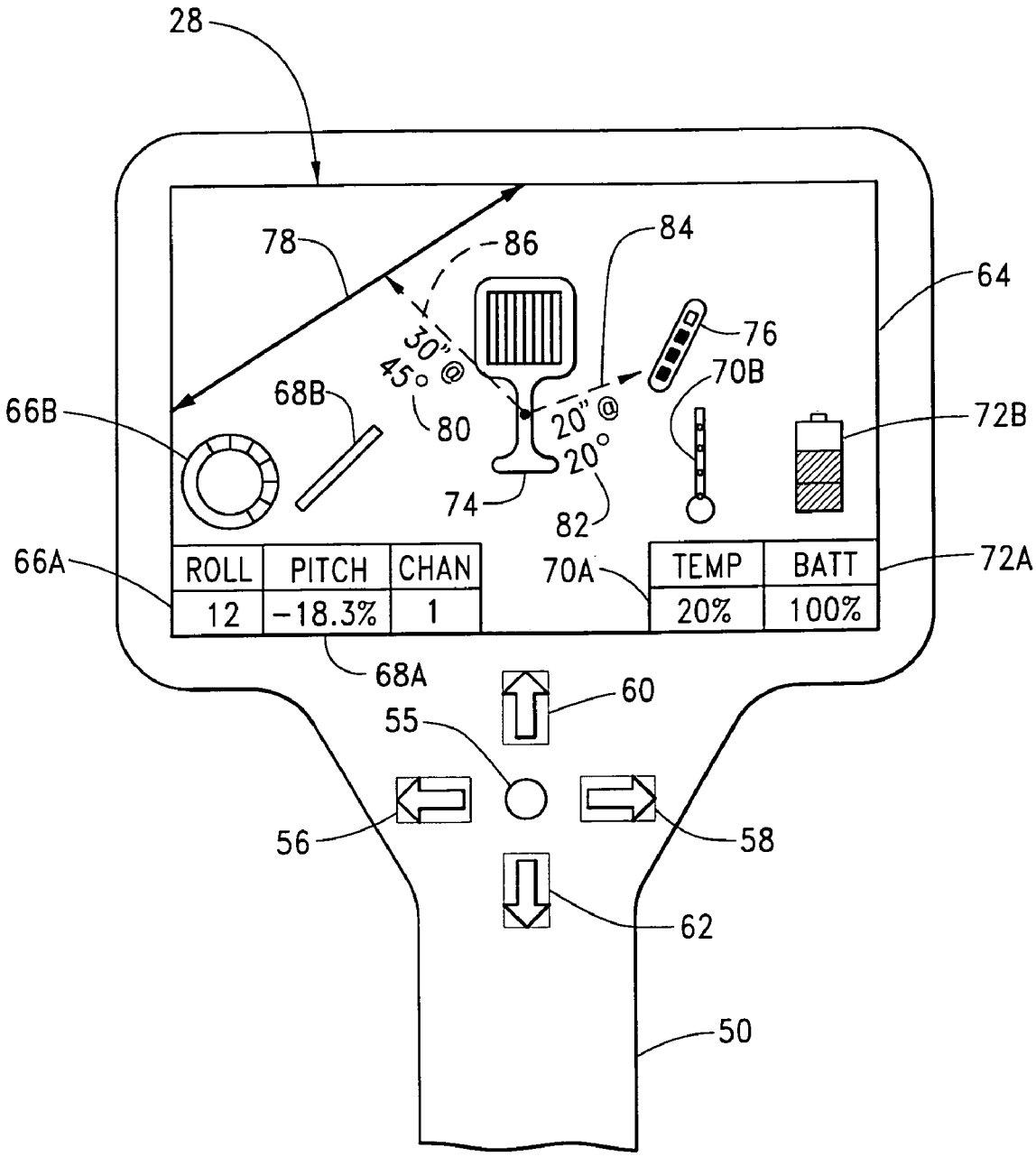
FIG. 4 is a fragmented plan view of the portable area monitoring system shown in FIG. 3. This figure is a diagrammatic representation of a display used to visually communicate a composite of the operating area. The display of the composite shows the positions of both a beacon and a fixed object relative to the portable area monitoring system.

Turning to FIG. 4, the display 28 of the frame 26 and certain controls are shown in more detail. The display 28 gives the operator a clear, easy-to-read display of the area through which the boring tool 22 and beacon 16 are moving. The controls comprising five keys 55–62 are positioned for convenient one-handed operation, and control all of the functions of the portable area monitoring system 14. The location, size and shape of these keys, preferably is designed for operation by the thumb of the hand that is holding the frame 26.

The display 28 is capable of providing the operator with a wide array of information related to the horizontal directional drilling operation. As shown in FIG. 4, a Liquid Crystal Display ("LCD") screen 64 may be used to display several operating parameters of the boring operation in addition to the positional relationship of the beacon 16, frame 26 and the fixed object 20. For example, the operator may monitor the roll and azimuthal orientation of the beacon 16 in relation to the fixed object 20 and the frame 26.

The display 28 is configured to use either textual characters or icons to display information to the operator. The operator is given the option of choosing between either textual display 66A or graphical display 66B to display roll orientation of the beacon. Likewise, the operator is given the option to choose between either textual displays 68A, 70A, and 72A, or graphical displays 68B, 70B, and 72B, to display pitch, temperature and battery strength respectively. However, the operator is also given the option of removing the above-described icons from the screen altogether and setting the icons to reappear when one or more operating parameters reach a critical range. For example, the battery strength icons 72A or 72B may be programmed to appear on the screen only when the battery strength falls below an optimal performance range.

In addition to displaying operation parameters, the LCD 64 is adapted to show a composite display of the operating area 6. The composite shows the relative positions of the beacon 16, the fixed object 20 and the frame 26 (FIG. 3). The frame 26 is represented by a frame icon 74. The beacon 16 and the fixed object 20 are represented on the LCD 64 by a beacon icon 76 and a fixed object icon 78, respectively. Numerical displays 80 and 82 may be used, in conjunction with broken line arrows 84 and 85, to communicate the horizontal distance, depth, and angle of orientation of the fixed object 20 and beacon 16 relative to the frame 26.

The frame icon 74 remains centered on the LCD 64 during operation of the system 14 as the positional relationship between the beacon 16, fixed object 20, and the frame 26 changes during the boring operation. The beacon icon 76 and object icon 78 also change azimuthal orientation relative to the frame icon 74 as azimuth of the beacon 16 and the fixed object 20 changes in relation to the frame 26.

Continuing with FIG. 4, the five keys 55–62 function to provide a user-friendly interface between the portable area monitoring system 14 and the operator. The menu key 55 does not merely bring up the menu screen, but is also used to revive the system after it has entered sleep mode. The left and right arrow keys 56 and 58 are used to adjust the LCD 64 contrast and backlight brightness. The up-arrow key 60 and the down-arrow key 62 are used to step through selections within functions and raise and lower adjustments such as sensor assembly 44 gain.

Figure 5:
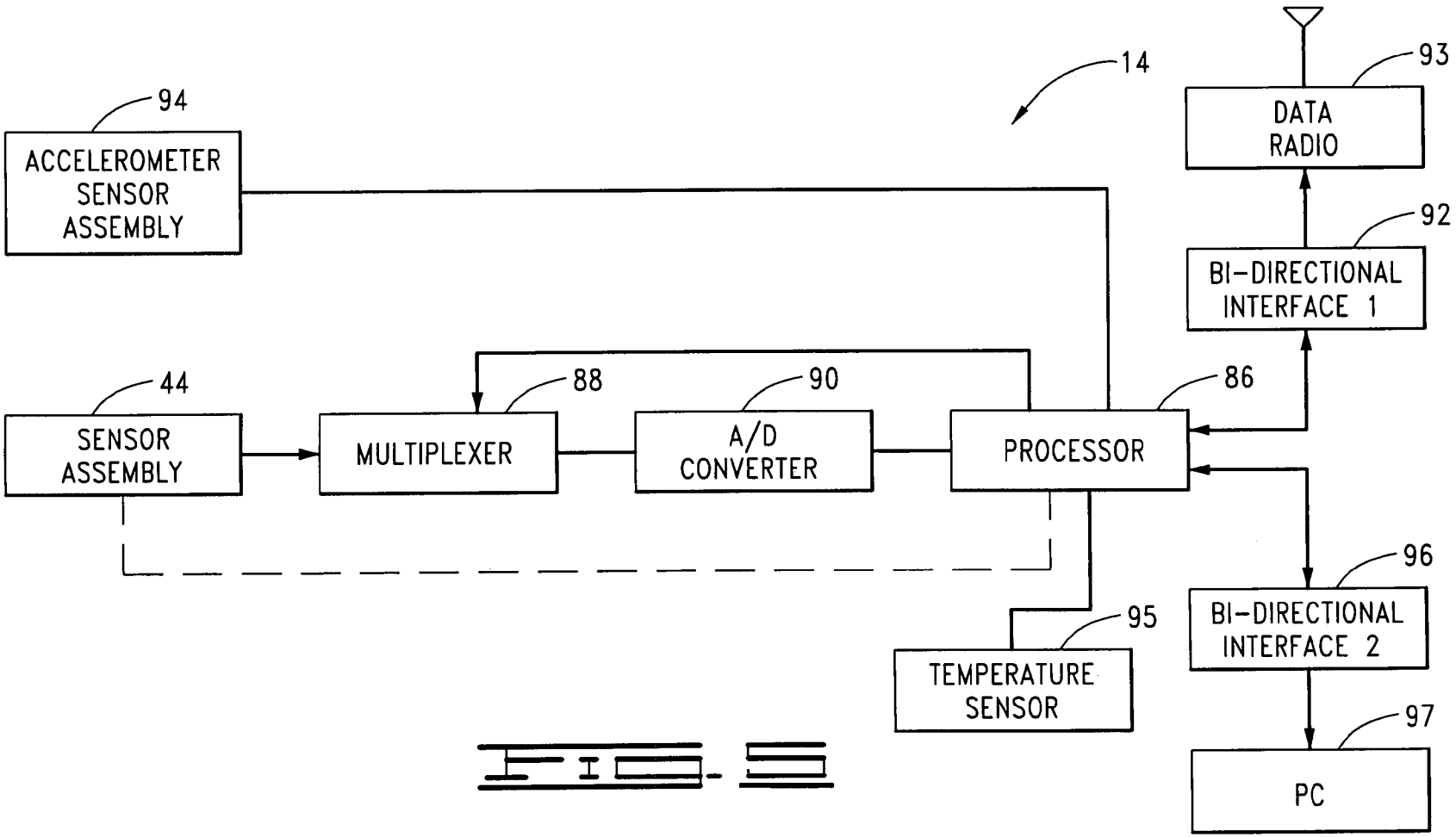
FIG. 5 is a block diagram of a portable area monitoring system constructed to detect and process signals emanating from a beacon and a fixed object.

Turning now to FIG. 5, the way in which the portable area monitoring system 14 produces a composite display of the relative positions of the frame 26, the beacon 16, and the fixed object 20 will be discussed. The portable area monitoring system 14 comprises the sensor assembly 44 and a processor 86. In addition, the system may comprise a multiplexer 88, an analog/digital (A/D) converter 90, a first bidirectional interface 92, a data radio 93, an accelerometer sensor assembly 94, and a temperature sensor 95.

The sensor assembly 44, as previously discussed, detects signals emanating from both the beacon 16 and the fixed object 20. These signals are amplified, filtered, and preconditioned for later use. The signals emanating from the beacon 16 and the fixed object 20 comprise a plurality of magnetic field components. Thus, the sensor assembly 44 detects the magnetic field components $H_X$, $H_Y$, and $H_Z$ for the x, y, and z axes, respectively, for each of the magnetic fields emanating from the beacon 16 (FIG. 1) and the fixed object 20 (FIG. 1). The sensor assembly 44 also produces one or more sensor signals in response to detecting the magnetic field components. The sensor signals contain data indicative of the magnetic field components. The sensor assembly 44 provides the initial amplification and conditioning of the signal.

The multiplexer 88 multiplexes detected signals transmitted from the sensor assembly 44 and transfers the detected signals to the A/D converter 90. The multiplexer has a plurality of input channels from the sensor assembly 44 and an output channel to the A/D converter 90. The processor 86 controls which input channel is connected to the output channel by sending a control signal to the multiplexer 88 designating the required input channel to be connected.

The A/D converter 90 accepts analog signals from the multiplexer 88, converts the signals to digital signals, and transfers the digital signals to the processor 86. In some instances, the processor 86 may control the start and end of the conversion process in the A/D converter 90.

The processor 86 receives the detected signals that may represent magnetic field component and accelerometer data. The processor 86 processes the magnetic field component data to produce a composite of the relative positions of the frame 26, the beacon 16 and the fixed object 20 within the operating area 6.

The processor 86 may control the sensor assembly 44, the multiplexer 88, the A/D converter 90, and the first bidirectional interface 92. The processor 86 also accepts data from the accelerometer sensor assembly 94 and the temperature sensor 95 to processes and transfers the data as required.

The first bidirectional interface 92 receives and transmits data to and from the processor 86. The bidirectional interface 92 is comprised of a data link interface to a wireless telemetry transmitter known as a data radio 93 which transmits data to a remote display (not shown) for drilling machine 10 operator observation and control. Using amplitude modulation of the signal, the first bidirectional interface 92 sends and receives data to and from the horizontal directional drilling machine 10 via the wireless data link antenna 48 (FIG. 3). The first bidirectional interface 92 typically is controlled by the processor 86.

A second bidirectional interface 96 receives and transmits data to and from a device external to the portable area monitoring system 14 and transfers the data to and from the processor 86. For example, the second bidirectional interface 96 may be a serial interface used to transfer configuration information or calibration information from a personal computer 97.

The accelerometer sensor assembly 94 may comprise sensors or sensor assemblies that provide environmental information, or other processing information to the processor 86. For example, the accelerometer sensor assembly 94 may comprise a tri-axial accelerometer which senses the attitude of the portable area monitoring system 14 with respect to gravity and/or other accelerations upon the portable area monitoring system. The accelerometer sensor assembly 94 may be connected to either the multiplexer 88, to the processor 86, or to both the multiplexer and the processor, depending on the components in the optional sensor assembly.

The temperature sensor 95 is adapted to continuously monitoring the temperature of air in the frame 26 and the temperature of the LCD 64. The temperature sensor 95 is connected to the processor 86 to provide information allowing the processor to adjust the contrast of the LCD 64 screen in response to air temperature and LCD temperature changes.

When the operator initiates the monitoring process, the portable area monitoring system 14 of FIG. 5 operates as follows. The fixed object 20 (See FIG. 1) to be avoided is impressed with, for example, a 1 kHz signal using the signal generator 24 (See FIG. 1). The beacon 16 is positioned within the boring tool 22 (FIG. 1) and transmits a magnetic field at a frequency different from the frequency used by the fixed object 20.

During the boring operation, the sensor assembly 44 detects the magnetic field components for a magnetic field 38 caused by the fixed object 20 that has an impressed signal as well as the magnetic field 34 emanating from the beacon 16. The sensor assembly 44 generates a corresponding sensor signal containing magnetic field component data for each magnetic field component that is detected.

The processor 86 sends a control signal to the multiplexer 88 so that the multiplexer will connect each input channel carrying the sensor signals from the sensor assembly 44 one-by-one to the multiplexer 88. Each of the signals are transferred to the A/D converter 90 where they are converted to digital signals and passed to the processor 86. The throughput of the multiplexer and A/D converter 90 may be designed sufficiently high that the digital representations of the magnetic field vector components sensed by the magnetic field sensors 52*x*–54*z* in sensor assembly 44 are satisfactorily equivalent to being measured at the same instant of time. For instance, a multiplexer switching speed of 100 kHz would allow the six antennas 52*x*–54*z* to be sampled through the A/D converter 90 in 60 microseconds. Alternatively, a "sample and hold" capability may be included within the system architecture.

The processor 86 continuously receives detected signals from the sensor assemblies 44 and 94, processes the signals, and produces a composite of the relative positions of the frame 26, the beacon 16, and the fixed object 20 within the operating area 6 of the horizontal directional drilling system. The processor 86 transfers the composite, having the values of the distances between the frame 26 and both of the beacon 16 and the fixed object 20, to the display 28 (See FIG. 1) for communication to the operator.

Figure 6:
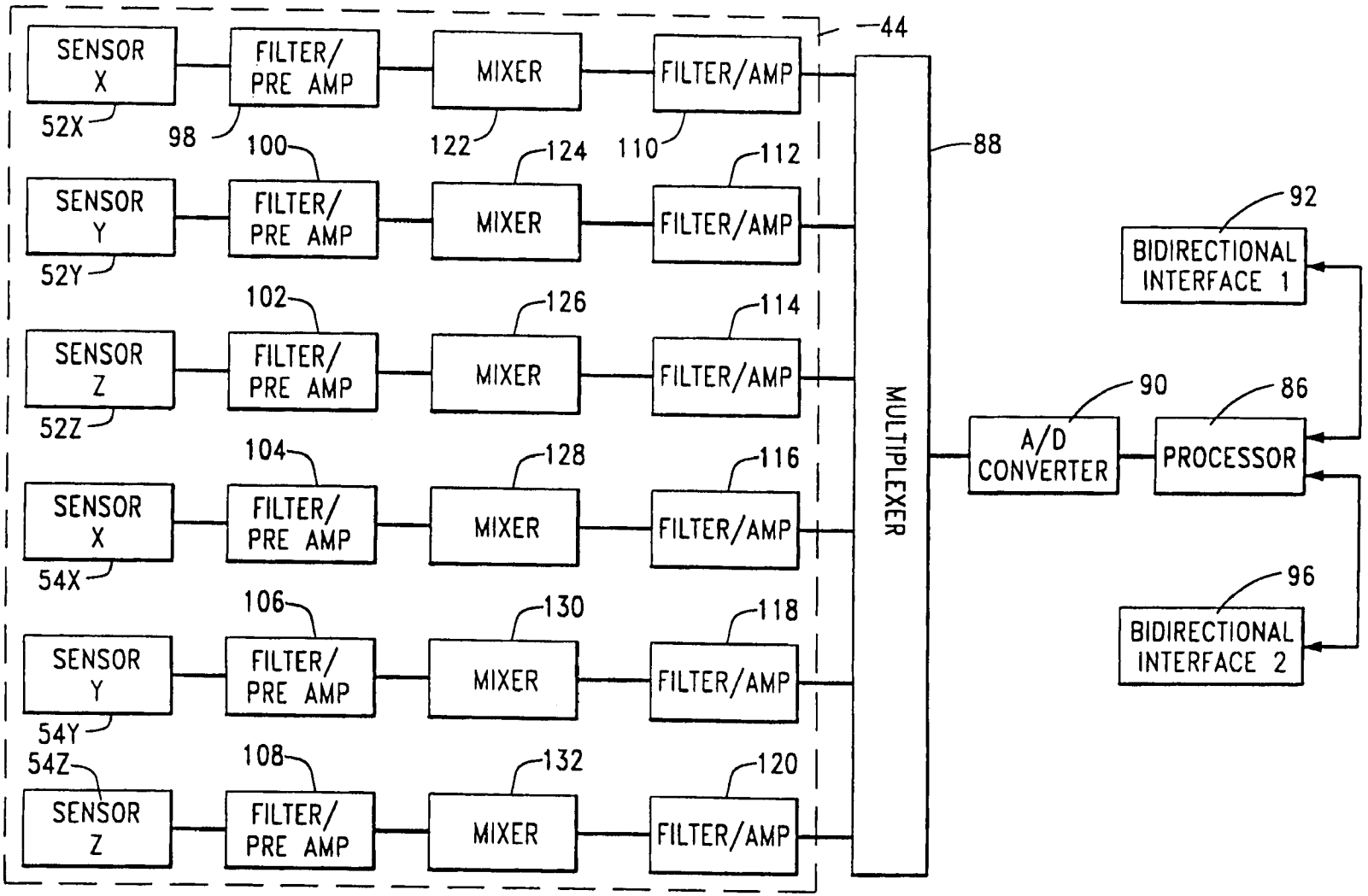
FIG. 6 is a block diagram of a sensor assembly and processor to detect signals emanating from both the beacon and the fixed object. The sensor assembly of FIG. 6 illustrates the use of filter/preamplifier and filter/amplifier assemblies to pre-condition signals detected by the sensor assembly.
Figure 5:
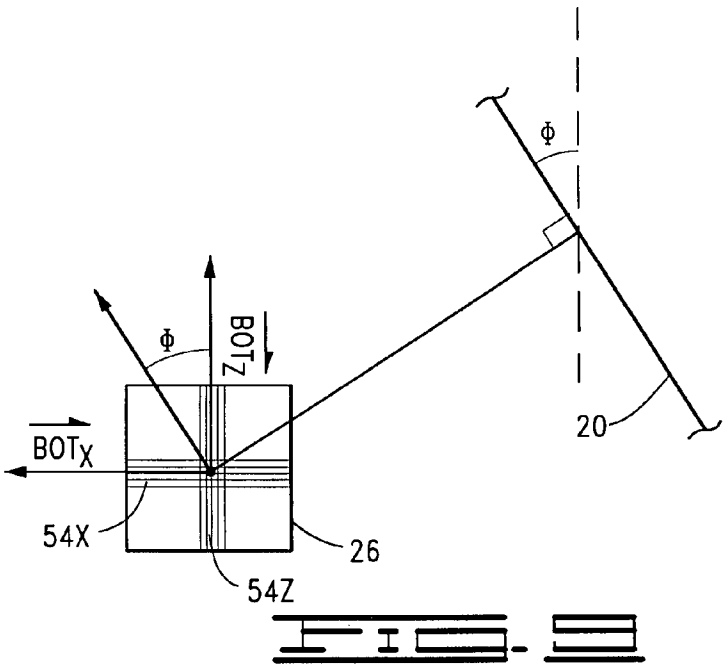

Referring now to FIG. 6, there is shown in more detail one preferred embodiment of the sensor assembly 44 with the processor 86 used in the portable area monitoring system 14 of the present invention. As previously discussed, the sensor assembly 44 comprises a plurality of coils 52*x*, 52*y*, 52*z*, 54*x*, 54*y*, and 54*z*. Each coil 52*x*, 52*y*, 52*z*, 54*x*, 54*y*, and 54*z* may be connected to one of a plurality of filter/preamplifier assemblies 98, 100, 102, 104, 106 and 108, and one of a plurality of filter/amplifier assemblies 110, 112, 114, 116, 118, and 120, respectively.

Continuing with FIG. 6, the coils 52*x*, 52*y*, 52*z*, 54*x*, 54*y*, and 54*z* are the x, y, and z sensors that detect the magnetic field for the $H_x$, $H_y$, and $H_Z$ components emanating from both the beacon 16 (FIG. 2) and the fixed object 20 (FIG. 2). Each of the coils 52*x*, 52*y*, 52*z*, 54*x*, 54*y*, and 54*z* produce a sensor signal in response to detecting the magnetic field components that are parallel with the sensitive axis of that coil. For example, coil 52*x* detects the $H_X$ components emanating from both the beacon 16 and the fixed object 20 and produces a sensor signal, composed of two desired primary frequencies, for transmission to the processor.

The filter/preamplifier assemblies 98, 100, 102, 104, 106 and 108 are used to reject noise and other unwanted components from the sensor signals. Band-pass filters are used to reject direct current (DC) and low-frequency AC noise. The filter/preamplifier assemblies 98–108 amplify the signals received from the filters for a higher gain.

The filter/amplifier assemblies 110–120 accentuate or remove certain spectral components from the signals and amplify the signals for a higher gain. The mixers 122–132, located between the filter/preamplifiers 98–108 and the filter/amplifiers 110–120 convert the input signal from the higher frequency signal into a lower base band signal.

In operation, the x-axis coils 52*x* and 54*x* detect the $H^{x^{beacon}}$ and $H_X^{object}$ components of the magnetic fields emanating from each of the beacon 16 and the fixed object 20. The y-axis coils 52*y* and 54*y* detect the $H_Y^{beacon}$ and $H^{y^{object}}$ components of the magnetic fields emanating from each of the beacon 16 and the fixed object 20. The z-axis coils 52*z* and 54*z* detect the $H_Z^{beacon}$ and $H_Z^{object}$ components of the magnetic fields emanating from each of the beacon 16 and the fixed object 20. Each of the coils 52*x*, 52*y*, 52*z*, 54*x*, 54*y*, and 54*z* transfer sensor signals having the magnetic field component data from both the beacon 16 and the fixed object 20 to the filter/preamplifier assemblies 98–108 which filter noise from the sensor signals and raise the gain of each sensor signal.

The filter/amplifiers 110–120 each raise or lower the gain of each sensor signal, filter out additional unwanted noise, and allow a designated bandwidth of the sensor signals to pass to the processor 86 via the multiplexer 88 and the A/D converter 90 for processing, as explained above.

Figure 8:
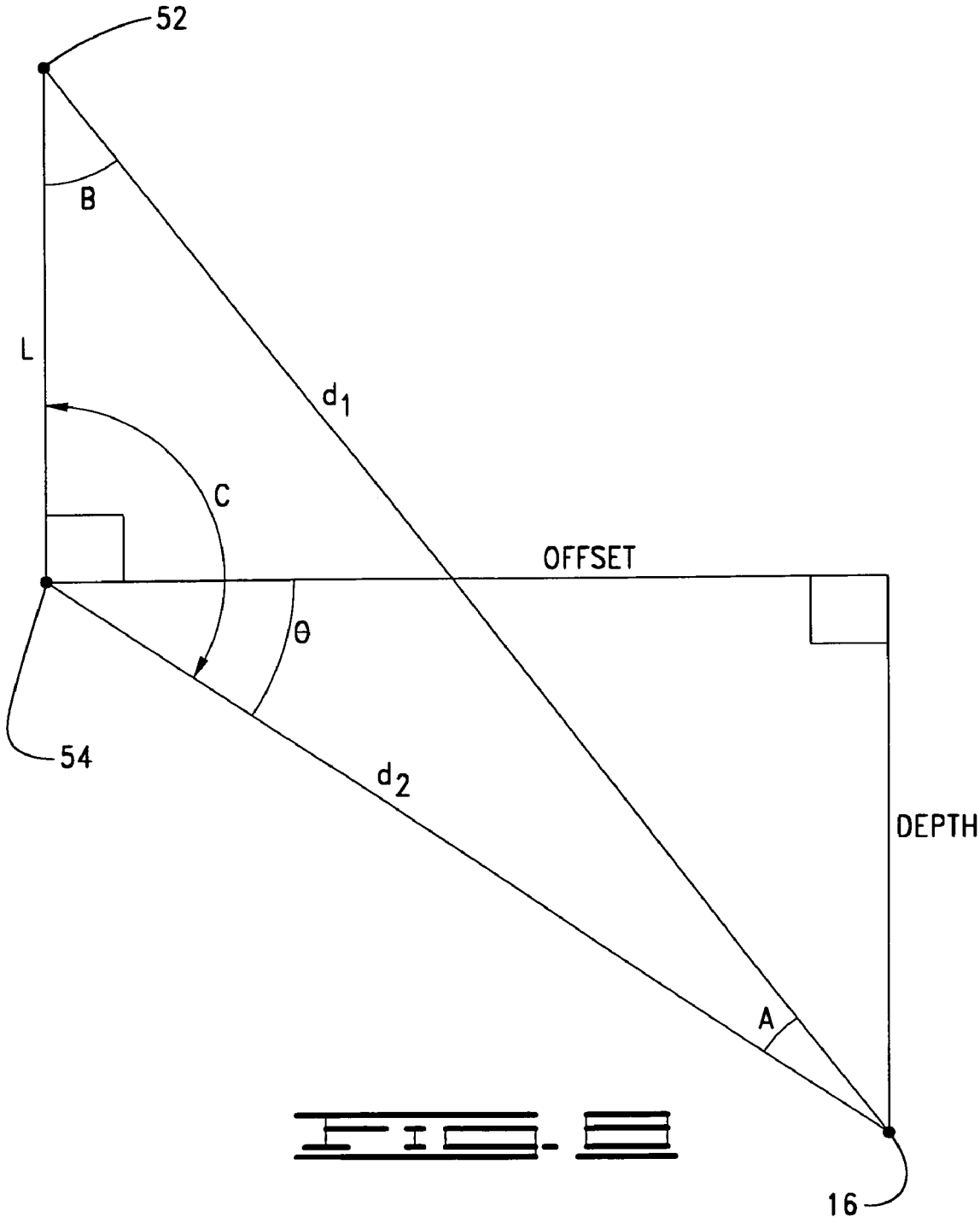
FIG. 8 is a diagram of the sensor assembly showing the geometry used to calculate the depth of the beacon below the portable area monitoring system and the offset distance of the beacon from the portable area monitoring system.

Turning now to FIG. 8, the use of antenna arrays 52 and 54 to determine the offset and depth between the beacon 16 and the frame 26 will be discussed. The primarily horizontal dipole magnetic field 34 (FIG. 2) emitted from the beacon 16 produces a magnetic density field with a third-order dependence on distance between the beacon and the antenna arrays 52 and 54.

$$S = \frac{k}{d^3} \qquad \text{EQ(1)}$$

In the above relationship, k represents a calibration constant determined by calibrating the antenna arrays 52 and 54 for use with the particular beacon 16. Using the calibration constant, k, and the measured dipole magnetic field signal strength, $S_1$, the distance, $d_1$, from the antenna array 52 to the beacon 16 may be obtained using the following relationship.

$$d_1 = \sqrt[3]{\frac{k}{S_1}} \quad \text{EQ(2)}$$

The distance, $d_2$, from the antenna array 54 to the beacon 16 may be obtained using the calibration constant, k, and the measured magnetic field signal strength, $S_2$, using the following relationship.

$$d_2 = \sqrt[3]{\frac{k}{S_2}} \quad \text{EQ(3)}$$

These distances, along with the known separation distance L from the arrays 52 and 54, can be used to calculate the offset, depth, and azimuth angle of the beacon with respect to the frame 26. It will be appreciated that the beacon 16 should be located fore and aft properly before the following equations are applied. Viewing the antenna arrays 52 and 54 and the beacon 16 from the end, FIG. 8 shows a triangular geometry with three known side lengths. Since the triangle formed by L, $d_1$, $d_2$ is not necessarily a right triangle, the law of cosines may be used to calculate the interior angles A, B & C:

Angle A is determined by:

$$\mathrm{COS}[A] = \frac{d_2^2 + d_1^2 - L^2}{2d_1 d_2} \quad \text{EQ(4)}$$

and angle B by:

$$\mathrm{SIN}[B] = \frac{d_2 \sin[A]}{L} \quad \text{EQ(5)}$$

and finally $$C=180-(A+B),\ \theta=C-90 \quad \text{EQ(6)}$$

then depth and offset can be calculated by:

$$\text{depth} = \sin(\theta)d_2 \quad \text{EQ(7)}$$

$$\text{offset} = \cos(\theta)d_2$$

The left/right orientation can be determined using the time derivative of signal strength in combination with monitoring system 14 accelerometer values from accelerometer sensor assembly 94 acquired during movement of the portable area monitoring system 14 transverse to the longitudinal axis of the beacon 16. Alternatively, the antenna arrays 52 and 54 could be placed in a horizontal plane approximately transverse to the beacon 16 axis relationship and amplitude used to determine left/right position. The azimuth angle between the frame 26 and the beacon 16 is determined by:

$$\theta = \sin^{-1}\left[\frac{|\overrightarrow{Bot_x}|}{(|Bot_x|^2 + |Bot_z|^2)^{\frac{1}{2}}}\right] \quad \text{EQ(8)}$$

Where $|Bot_x|$ and $|Bot_z|$ are the horizontal orthogonal magnitudes of the beacon's 16 magnetic field as measured by the antenna arrays 54 and 52.

Turning back to FIG. 7, it may be assumed that the fixed object 20 is a filamentary conductor, such as a utility line, a telecommunications line, or another object upon which a signal is impressed, thereby producing an active magnetic field, and that the conductor is collinear with the z-axis of a Cartesian coordinate system 182, going into the page. The beacon 16 producing a dipole magnetic field defines another Cartesian coordinate system 184. The frame 26 with a sensor assembly 44 containing two sets of three orthogonal magnetic field sensors define another Cartesian coordinate system 186. For purposes of the analysis, the y-axes of the three coordinate systems 182, 184 and 186 are parallel.

The sensor assembly 44 is shown with antenna array 52 (Top) and antenna array 54 (Bot). For simplicity, only the magnetic field sensors 52*x*, 54*x*, 52*y*, and 54*y*, sensitive to x-axis and y-axis vector field components are shown. The separation of each antennae array 52 and 54 is a known distance L. The offset distance between the beacon 16 and the fixed object 20 is labeled as X, while the depth of the fixed object is represented by Y. The vector from the bottom antenna array 54 to the fixed object 20 is represented as $r_2$ and the vector from the top antenna array 52 to the fixed object is $r_1$.

The magnetic field components designated by $Top_x$, $Top_y$, $Bot_x$, and $Bot_y$ may be used to calculate the interior angles $\theta_1$ and $\theta_3$ of the triangle 188 formed by the intersection of the top antenna array 52, the bottom antenna array 54, and the fixed object 20.

The angles $\theta_1$, $\theta_2$, and $\theta_3$ are calculated by measuring all of the top and bottom antennae magnetic field components using magnetic field sensors 52*x*, 54*x*, 52*y*, and 54*y* and then calculating the total fields for each. The total fields are designated by Top and Bot, respectively. These angles are calculated from the frequency components emitted by object 20 alone. The beacon 16 frequency components are removed from the received signal by the processor 86 using digital signal processing means (not shown) having a combination of high-pass, band-pass, and low-pass filters to separate the desired components.

$$\theta_1 = \sin^{-1}\left[\frac{|\overrightarrow{Top_y}|}{|\overrightarrow{Top}|}\right] \theta_2 = \sin^{-1}\left[\frac{|\overrightarrow{Bot_y}|}{|\overrightarrow{Bot}|}\right] \text{ and } \theta_3 = \theta_2 - \theta_1 \quad \text{EQ(9)}$$

$$|\overrightarrow{Top}| = \left(|\overrightarrow{Top_x}|^2 + |\overrightarrow{Top_y}|^2\right)^{\frac{1}{2}} \text{ and } |\overrightarrow{Bot}| = \left(|\overrightarrow{Bot_x}|^2 + |\overrightarrow{Bot_y}|^2\right)^{\frac{1}{2}} \quad \text{EQ(10)}$$

Then, using the determinations above, the law of sines may be used to form the relationships:

$$\frac{r_2}{\sin\theta_1} = \frac{L}{\sin\theta_3} \quad \text{EQ(11)}$$

$$r_2 = \frac{L\sin\theta_1}{\sin(\theta_2 - \theta_1)} \quad \text{EQ(12)}$$

The denominator and the numerator of above equations may then be expanded. Thus, eliminating the trigonometric functions and allowing easy numerical calculation.

$$r_2 = \frac{L \cdot \frac{|\overrightarrow{Top_y}|}{|\overrightarrow{Top}|}}{\left[\frac{|\overrightarrow{Bot_y}|}{|\overrightarrow{Bot}|} \cdot \sqrt{1 - \frac{|\overrightarrow{Top_y}|^2}{|\overrightarrow{Top}|^2}}\right] - \left[\frac{|\overrightarrow{Top_y}|}{|\overrightarrow{Top}|} \cdot \sqrt{1 - \frac{|\overrightarrow{Bot_y}|^2}{|\overrightarrow{Bot}|^2}}\right]} \quad \text{EQ(13)}$$

Then, using the above determinations, the offset X and depth Y may be determined using the following equations:

$$X = r_2\sin\theta_2 = r_2 \cdot \frac{|\overrightarrow{Bot_y}|}{|\overrightarrow{Bot}|} \quad \text{EQ(14)}$$

$$Y = r_2\cos\theta_2 = r_2 \cdot \sqrt{\left(1 - \left[\frac{|\overrightarrow{Bot_y}|}{|\overrightarrow{Bot}|}\right]^2\right)} \quad \text{EQ(15)}$$

Figure 10:
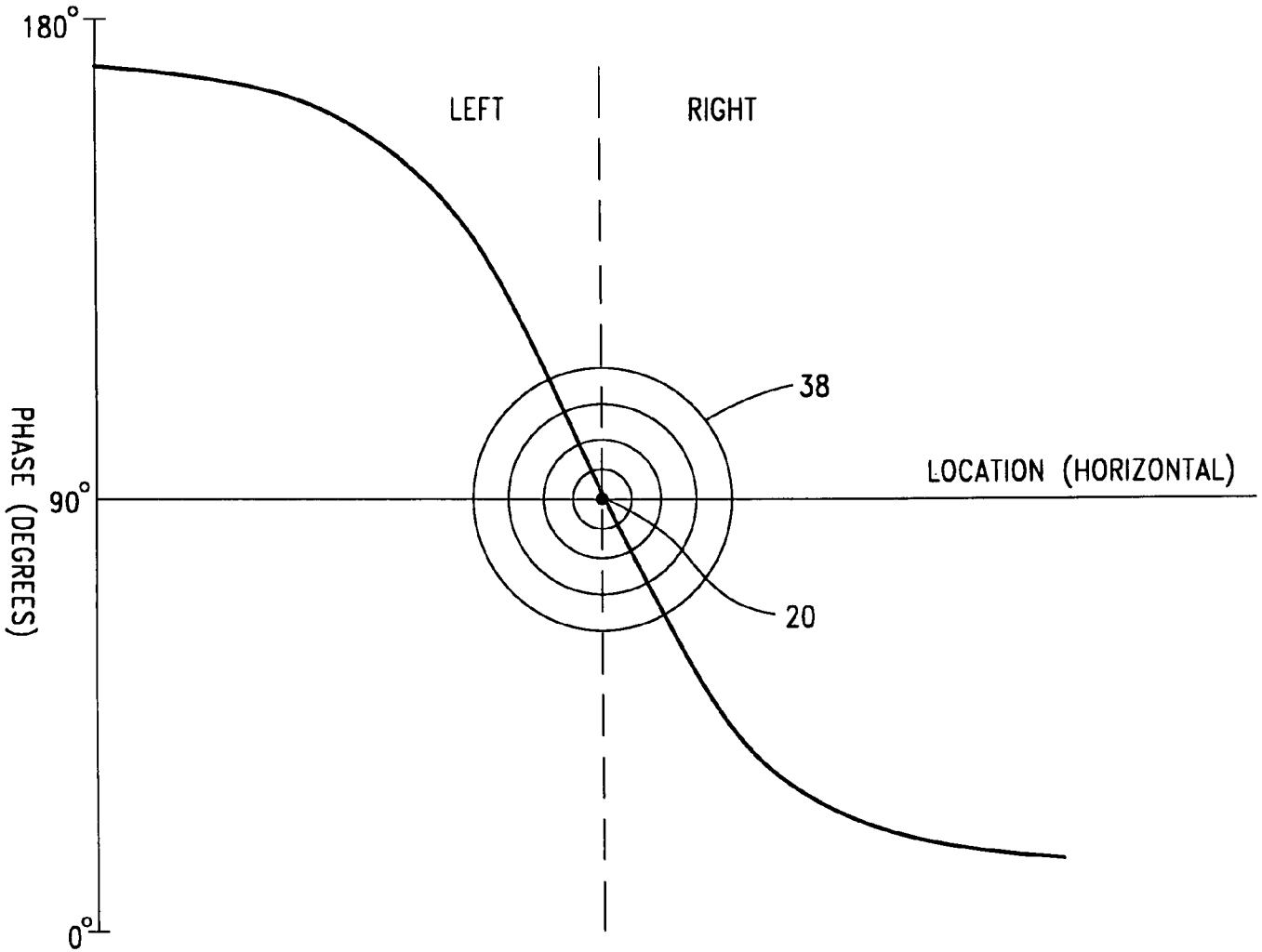
FIG. 10 is a chart illustrating the use of magnetic field phase relationships to determine the relative left/right positions of the portable area monitoring system with respect to the fixed object within the operating area.

Since the calculation for $r_2$ may become unstable when the value of $\theta_2$ approaches an equal value for $\theta_1$, it is necessary to also use the phase between either the $Top_x$, $Top_y$ or $Bot_x$, $Bot_y$ magnetic field components, to determine left/right position. The phase between the bottom horizontal coil 54$x$ and the bottom vertical coil 54$y$ varies from zero degrees phase to one-hundred and eighty degrees out-of-phase. This relationship is shown in FIG. 10.

When the relative phase approaches ninety degrees, $\theta_2$ approaches $\theta_1$, and $r_2$ becomes unstable, the usage of equations (14) and (15) are discontinued and replaced with the following equations.

$$x=0 \quad \text{EQ(16)}$$

$$y = \frac{L}{\left(\frac{|BOT_x|}{|TOP_x|}\right) - 1} \quad \text{EQ(17)}$$

The above equations are derived where area portable area monitor 14 is directly above beacon 16. When the portable area monitoring system 14 is not directly over beacon 16 (FIG. 4), it may be appreciated that similar derivations can be performed to determine the positions of both fix object 20 and beacon 16 with respect to the frame 26. It should also be understood that both frequency components may be detected and filtered by processor 86 using a digital signal processing means to detect phase, amplitude, and frequency of each object's frequency.

Turning now to FIG. 9, it will be appreciated that a third angle Φ can be derived. Angle Φ is the azimuthal angle between the fixed object 20 and the frame 26. In order to make this calculation, only one of the two sets of orthogonal antennas is necessary. For purposes of illustration, the azimuthal angle of the fixed object 20 in FIG. 9 is calculated using only antennas 54$x$ and 54$z$. However, either antenna array 52 or 54 may be used to measure the $H_X$ and $H_Z$ magnetic field components emanating from the fixed object. The azimuthal angle Φ between the frame 26 and the fixed object 20 is calculated as:

$$\theta = \sin^{-1}\left[\frac{|\overrightarrow{Bot_x}|}{\left(|\overrightarrow{Bot_x}|^2 + |\overrightarrow{Bot_z}|^2\right)^{\frac{1}{2}}}\right] \quad \text{EQ(18)}$$

Thus, using the above-determined data and calculations, the processor is able to produce a composite of the operating area 6 of the horizontal directional drilling system showing the relative locations of the frame, the beacon, and the fixed object.

The present invention also comprises a method for monitoring the position of a beacon 16 and a fixed signal emitting object 20 within an area of operation of a horizontal directional drilling system. In accordance with the method of the present invention, the beacon 16 and the fixed object 20 are monitored using a portable area monitoring system 14. The portable area monitoring system comprises a frame 26 within which is supported a sensor assembly 44.

Having determined the need for tracking the beacon 16 and avoiding the signal emitting object 20, the portable area monitoring system is used to sense signals emanating from the beacon and the signal emitting object. The signals are then simultaneously processed to generate a composite of the relative positions of the frame 26, the beacon 16 and the signal emitting object 20 within the operating area 6.

In accordance with the present method, the frame 26 may have a display 28 adapted to display the relative positions of the frame, the beacon 16, and the signal emitting object 20. Thus, the present invention is capable of providing the operator with a composite display of the beacon's 16 position relative to the signal emitting object 20 so that accidental strikes may be avoided.

Various modifications can be made in the design and operation of the present invention without departing from the spirit thereof. Thus, while the principal preferred construction and modes of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A portable area monitoring system for monitoring the position of a plurality of signal emitting objects within an operating area, the system comprising:

a sensor assembly adapted to detect a plurality of signals emanating from the plurality of signal emitting objects and to transmit the plurality of detected signals; and a processor adapted to receive the plurality of detected signals, to process the plurality of detected signals, and to produce a composite of the relative positions of the monitoring system and the plurality of signal emitting objects within the operating area.

2. The portable area monitoring system of claim 1 wherein the sensor assembly comprises:

a plurality of sensors each adapted to detect the signals emanating from the plurality of signal emitting objects and to transmit the detected signals in a plurality of sensor signals;

a plurality of filter/preamplifier assemblies each adapted to receive one of the sensor signals from the sensors, to filter signal components from the received sensor signal, and to amplify the received sensor signal; and a plurality of filter/amplifier assemblies each adapted to receive one of the sensor signals from the filter/preamplifier assemblies, to filter spectral components from the received sensor signal, and to amplify the received sensor signal before the received sensor signal is transmitted to the processor.

3. The portable area monitoring system of claim 1 further comprising a display, the display being adapted to communicate the composite of the relative positions of the monitoring system and the plurality of signal emitting objects.

4. The portable area monitoring system of claim 3 wherein the display is further adapted to display a roll and azimuth orientation components of at least one of the plurality of signal emitting objects.

5. The portable area monitoring system of claim 3 further comprising a temperature sensor adapted to change a contrast feature of the display in response to changes in temperature.

6. The portable area monitoring system of claim 3 wherein the display further comprises a plurality of icons.

7. The portable area monitoring system of claim 1 further comprising a display adapted to communicate the composite of the relative position of the monitoring system and the plurality of signal emitting objects using a plurality of unique icons representative of each of the plurality of signal emitting objects and the monitoring system.

8. The portable area monitoring system of claim 7 wherein the unique icons comprise a beacon icon and a line icon.

9. The portable area monitoring system of claim 1 wherein the sensor assembly comprises at least two sets of three mutually orthogonal coils disposed vertically relative to each other.

10. The portable area monitoring system of claim 1 wherein the sensor assembly comprises at least two antennas disposed horizontally relative to each other.

11. The portable area monitoring system of claim 1 wherein the plurality of signal emitting objects comprise a plurality of lines and wherein the composite produced by the processor further comprises the position and orientation of the lines relative to each other and to the monitoring system.

12. The portable area monitoring system of claim 1 wherein the plurality of signal emitting objects comprise a plurality of movable objects and wherein the composite produced by the processor further comprises the position and orientation of the movable objects relative to each other and to the monitoring system.

13. The portable area monitoring system of claim 1 wherein the processor is further adapted to determine a distance between at least two of the plurality of signal emitting objects.

14. The portable area monitoring system of claim 1 wherein the processor is further adapted to determine a distance and horizontal displacement between each of the plurality of signal emitting objects.

15. The portable area monitoring system of claim 1 further comprising a communications link adapted to transmit a signal when a first of the plurality of signal emitting objects and a second of the plurality of signal emitting objects are in a predetermined relationship relative to each other.

16. The portable area monitoring system of claim 1 further comprising a communications link adapted to transmit a signal indicative of the position and orientation of each of the plurality of signal emitting objects.

17. A method for monitoring the position of a plurality of signal emitting objects disposed within an area of operation using a portable area monitoring system, the method comprising:

sensing a plurality of signals emitted from the plurality of signal emitting objects; and processing the plurality of signals to generate a composite of the relative positions of the monitoring system and each of the plurality of signal emitting objects within the operating area.

18. The method of claim 17 further comprising displaying the relative positions of the monitoring system and each of the plurality of signal emitting objects.

19. The method of claim 17 further comprising recording the position of at least one of the plurality of signal emitting objects.

20. The method of claim 17 further comprising transmitting the position of at least one of the signal emitting objects to a receiver remote from the portable area monitoring system.

21. The method of claim 17 further comprising transmitting a signal from the monitoring system to a control system to maintain a predetermined relationship between each of the plurality of signal emitting objects.

22. The method of claim 17 wherein the portable area monitoring system comprises a display for communicating the composite of the relative positions of the monitoring system and each of the plurality of signal emitting objects, wherein the method further comprises automatically adjusting a characteristic of the display in response to temperature changes.

23. The method of claim 22 wherein the display characteristic comprises contrast.

24. A system for determining the position of each of a plurality of signal emitting objects disposed within an operating area, the system comprising:

a sensor assembly adapted to detect a plurality of signals emanating from the plurality of signal emitting objects and to transmit the plurality of detected signals;

a processor adapted to receive the plurality of detected signals, to process the plurality of detected signals, and to produce a composite of the relative positions of the sensor assembly and the plurality of signal emitting objects within the operating area; and a communications link adapted to transmit information indicative of the positions of each of the signal emitting objects.

25. The system of claim 24 wherein the sensor assembly comprises a plurality of sensors each adapted to detect the signals emanating from the plurality of signal emitting objects and to transmit the detected signals in a plurality of sensor signals.

26. The system of claim 24 further comprising a display, the display being adapted to communicate the composite of the relative positions of the monitoring system and the plurality of signal emitting objects.

27. The system of claim 24 comprising a receiver and a display both disposed remotely from the sensor assembly, wherein the receiver is adapted to receive information indicative of the positions of each of the signal emitting objects from the communications link, and wherein the display is adapted to communicate the composite of the relative positions of the sensor assembly and the plurality of signal emitting objects in response to the signal received from the communications link.

28. The system of claim 27 wherein the display is further adapted to display a roll or azimuth orientation component of at least one of the plurality of signal emitting objects.

29. The system of claim 27 further comprising a temperature sensor adapted to change a contrast feature of the display in response to changes in temperature.

30. The system of claim 24 further comprising a frame and a display, wherein the frame is adapted to support the sensor assembly and the display thereon.

31. The system of claim 30 wherein the display is adapted to display a plurality of icons representative of the plurality of signal emitting objects.

32. The system of claim 31 wherein the unique icons comprise a beacon icon and a line icon.

33. The system of claim 24 further comprising a display adapted to communicate the composite of the relative position of the monitoring system and the plurality of signal emitting objects using a plurality of unique icons representative of each of the plurality of signal emitting objects and the monitoring system.

34. The system of claim 24 wherein the sensor assembly comprises at least two sets of three mutually orthogonal coils disposed vertically relative to each other.

35. The system of claim 24 wherein the sensor assembly comprises at least two antennas disposed horizontally relative to each other.

36. The system of claim 24 wherein the plurality of signal emitting objects comprise a plurality of lines and wherein the composite produced by the processor further comprises the position and orientation of the lines relative to each other and to the monitoring system.

37. The system of claim 24 wherein the plurality of signal emitting objects comprise a plurality of movable objects and wherein the composite produced by the processor further comprises the orientation of each of the movable objects.

38. The system of claim 24 wherein the processor is further adapted to determine a distance between at least two of the plurality of signal emitting objects.

39. The system of claim 24 wherein the processor is further adapted to determine a distance and horizontal displacement between each of the plurality of signal emitting objects.

40. The system of claim 24 further comprising a communications link adapted to transmit a signal when a first of the plurality of signal emitting objects and a second of the plurality of signal emitting objects are in a predetermined relationship relative to each other.

41. The system of claim 24 further comprising a communications link adapted to transmit a signal indicative of the position and orientation of each of the plurality of signal emitting objects.

* * * * *